US010749295B2

(12) United States Patent
Mayer et al.

(10) Patent No.: US 10,749,295 B2
(45) Date of Patent: Aug. 18, 2020

(54) CONNECTING STRUCTURE AND CONNECTOR

(71) Applicant: Rosenberger Hochfrequenztechnik GmbH & Co. KG, Fridolfing (DE)

(72) Inventors: Florian Mayer, Tyrlaching (DE); Christian Biermann, Freilassing (DE); Till Bredbeck, Traunstein (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 16/375,969

(22) Filed: Apr. 5, 2019

(65) Prior Publication Data

US 2019/0319404 A1 Oct. 17, 2019

(30) Foreign Application Priority Data

Apr. 11, 2018 (JP) ..... 2018-075995

(51) Int. Cl.
*H01R 13/639* (2006.01)
*H01R 13/15* (2006.01)
(Continued)

(52) U.S. Cl.
CPC ..... *H01R 13/639* (2013.01); *H01R 13/15* (2013.01); *H01R 13/6271* (2013.01); *H01R 13/631* (2013.01); *H01R 24/40* (2013.01)

(58) Field of Classification Search
CPC ... H01R 13/639; H01R 13/15; H01R 13/6271
(Continued)

(56) References Cited

U.S. PATENT DOCUMENTS 5,672,071 A * 9/1997 Ceru ..... H01R 13/6272 439/352
5,681,178 A * 10/1997 Kunkle ..... H01R 13/641 439/352

(Continued)

FOREIGN PATENT DOCUMENTS

| | | | |
|---|---|---|---|
| DE | 19858467 | A1 | 7/1999 |
| EP | 2637260 | A1 | 9/2013 |
| JP | 2002141145 | A | 5/2002 |

*Primary Examiner* — Alexander Gilman
(74) *Attorney, Agent, or Firm* — David P. Dickerson

(57) ABSTRACT

With the aim of addressing the problem of maintaining a state in which a plurality of connectors are securely mated, the present disclosure teaches a connecting structure S that is a structure for connecting a first connector 1 and a second connector 2. The first connector 1 comprises a first housing 11 provided around the first connection terminal 10 and having at least one opening, and the second connector 2 comprises: a second housing 21 which is provided around a second connection terminal 20 and has an engaging portion 22 which engages with an opening 12 formed in the first housing 11 in a state in which the first connection terminal 10 and the second connection terminal 20 are mated and said second housing 21 is mated with the first housing 11; and a locking member 24 which is able to move in a longitudinal direction of the connecting structure S and prevents displacement of the engaging portion 22 in a direction of disengagement from the opening 12 in a state in which said locking member 24 is pushed in up to a predetermined position on the first connector 1 side.

15 Claims, 6 Drawing Sheets

(51) Int. Cl.
*H01R 13/627* (2006.01)
*H01R 13/631* (2006.01)
*H01R 24/40* (2011.01)

(58) Field of Classification Search
USPC ..... 439/352
See application file for complete search history.

(56) References Cited

U.S. PATENT DOCUMENTS

| | | | | |
|---|---|---|---|---|
| 5,910,027 | A * | 6/1999 | Wayt | H01R 13/641 439/352 |
| 6,132,233 | A * | 10/2000 | Fukuda | H01R 13/6272 439/352 |
| 6,468,105 | B2 * | 10/2002 | Noguchi | H01R 13/4367 439/352 |
| 8,920,187 | B2 * | 12/2014 | Kon | H01R 13/641 439/352 |
| 9,054,458 | B1 * | 6/2015 | Ng | H01R 13/641 |
| 10,135,172 | B1 * | 11/2018 | Foltz | H01R 13/4368 |
| 2002/0052135 | A1 | 5/2002 | Noguchi et al. | |
| 2017/0040741 | A1 * | 2/2017 | Droesbeke | H01R 13/506 |

* cited by examiner

CONNECTING STRUCTURE AND CONNECTOR

FIELD OF THE INVENTION

The present invention relates to a connecting structure for connecting a plurality of connectors, and to a connector connected to another connector by means of said connecting structure.

TECHNICAL BACKGROUND

A large number of signal cables are wired into various types of moving bodies including motor vehicles. Connecting structures for mating the signal cables and a circuit board in order to connect the signal cables and the circuit board are known in the art. JP 2015-93650 A describes a connecting structure for a connector which is used in a vehicle.

SUMMARY OF THE INVENTION

A connector used in a moving body needs to be very reliable. In a conventional connecting structure, however, a male-side connector and a female-side connector are simply mated, so if the two connectors are not properly mated at the time of production or a connector housing is damaged, a problem arises in that there is a risk of the connectors detaching due to rocking that accompanies movement of the moving body. There is also a risk of the same problem arising in connectors used in devices other than moving bodies if the connectors are not properly mated during production.

The present invention has therefore been devised in light of the above matters, and the aim thereof lies in readily maintaining a state in which a plurality of connectors are securely mated.

A connecting structure according to a first mode of the present invention is a structure for connecting a first connector having a first connection terminal, and a second connector having a second connection terminal able to mate with the first connection terminal. The first connector comprises a first housing provided around the first connection terminal and having at least one opening, and the second connector comprises: a second housing which is provided around the second connection terminal and has an engaging portion which engages with the opening formed in the first housing in a state in which the first connection terminal and the second connection terminal are mated and said second housing is mated with the first housing, and a locking member which is able to move in a longitudinal direction of the connecting structure and prevents displacement of the engaging portion in a direction of disengagement from the opening in a state in which said locking member is pushed in up to a predetermined position on the first connector side.

The locking member may be able to move up to the predetermined position on the first connector side in a state in which the first connection terminal and the second connection terminal are mated, and may not move up to the predetermined position in a state in which the first connection terminal and the second connection terminal are not mated.

The engaging portion may deform to a state in which it is disengageable from the opening as a result of an external force being applied in a state in which the locking member is not pushed in to the first connector side, and the engaging portion may not deform to a state in which it is disengageable from the opening when an external force is applied in a state in which the locking member is pushed in to the first connector side.

The second housing may further comprise an engagement release portion for applying stress to the engaging portion in such a way that the engaging portion deforms to a state in which it is disengageable from the opening as a result of the external force being applied.

When the external force is applied to the engagement release portion in a state in which the locking member is not pushed in to the first connector side, the engagement release portion may deform in such a way as to apply the stress required in order for the engaging portion to deform to a state in which it is disengageable from the opening, and when the external force is applied to the engagement release portion in a state in which the locking member is pushed in to the first connector side, the engagement release portion may deform in such a way as to apply a smaller stress than the stress required in order for the engaging portion to deform to a state in which it is disengageable from the opening.

The locking member may comprise a deformation-preventing portion which does not come into contact with the engagement release portion in a state in which the locking member is not pushed in to the first connector side, and which prevents deformation of the engagement release portion in a state in which the locking member is pushed in to the first connector side.

The engaging portion may comprise: a recess into which a tip end of the locking member is inserted in a state in which the locking member is pushed in to the first connector side, and a protrusion engaging with the opening, and the amount of displacement of the protrusion in a direction of disengagement from the opening in a state in which the locking member is inserted in the recess may be smaller than the amount of displacement of the protrusion in the direction of disengagement from the opening in a state in which the locking member is not inserted in the recess.

A connector according to a second mode of the present invention comprises: a second connection terminal able to mate with a first connection terminal of another connector, a second housing which is provided around the second connection terminal and has an engaging portion which engages with an opening formed in a housing of the other connector in a state in which the first connection terminal and the second connection terminal are mated and said second housing is mated with the housing of the other connector, and a locking member which is able to move to the other connector side and prevents displacement of the engaging portion in a direction of disengagement from the opening in a state in which said locking member is pushed in up to a predetermined position on the other connector side.

The present invention demonstrates an advantage in that it is possible to readily maintain a state in which a plurality of connectors are securely mated.

DETAILED DESCRIPTION

Figure 1:
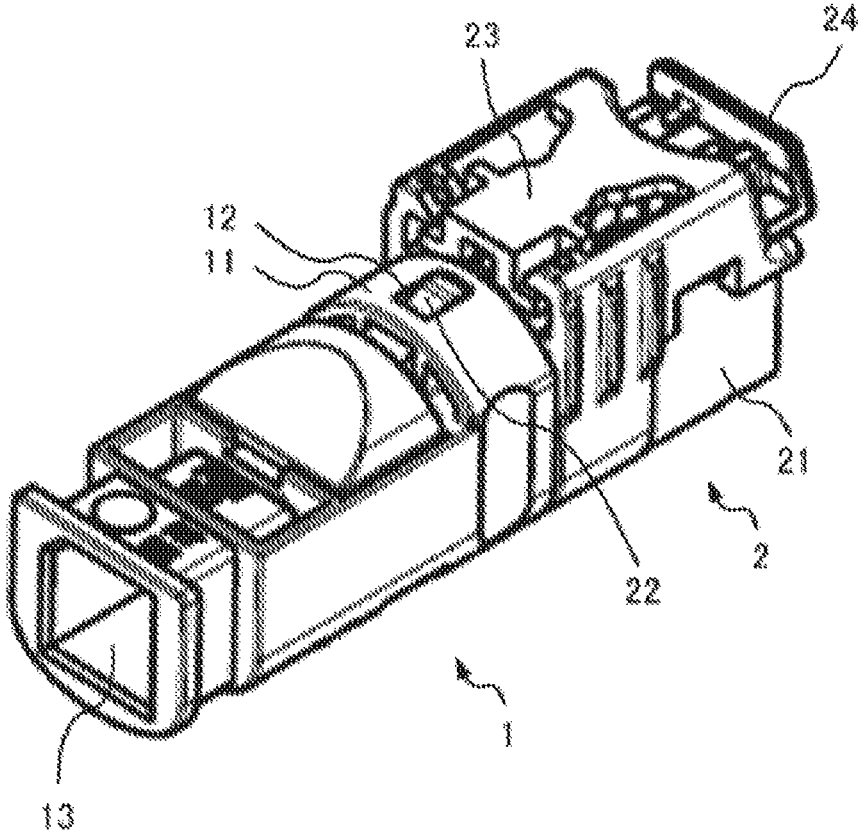
FIG. 1 shows the configuration of a connecting structure according to a mode of embodiment.

FIG. 1 shows the configuration of a connecting structure S according to this mode of embodiment. The connecting structure S is a structure for connecting a first connector 1 and a second connector 2. FIG. 1 is an oblique view in a state in which the first connector 1 and the second connector 2 are mated. In the present specification, the orientation of the connecting structure S facing towards the first connector 1 may be referred to as the front and the orientation facing towards the second connector 2 may be referred to as the rear. Furthermore, the direction joining the first connector 1 and the second connector 2 may be referred to as the longitudinal direction.

Figure 2A:
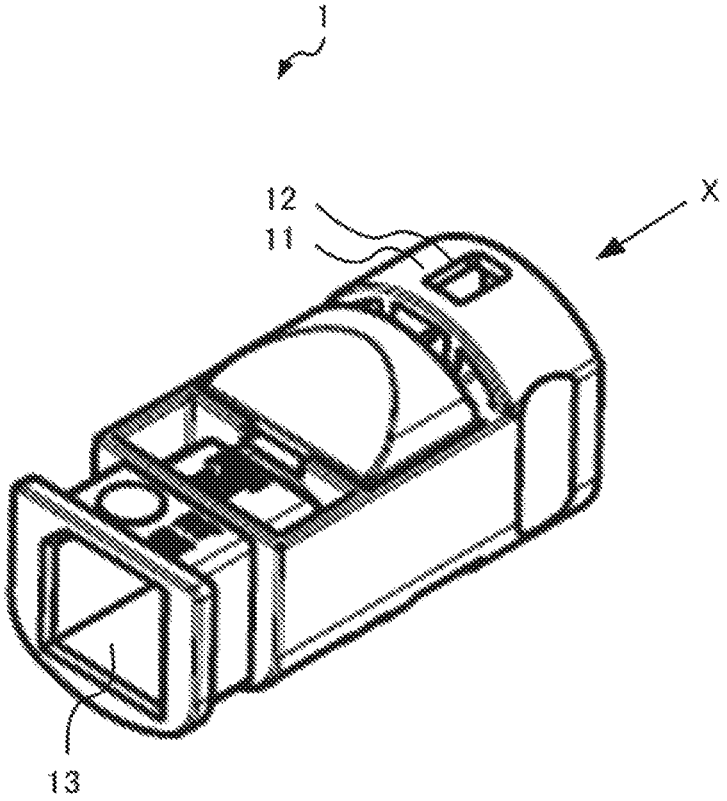
FIG. 2*a* is an external view of a first connector.
Figure 2B:
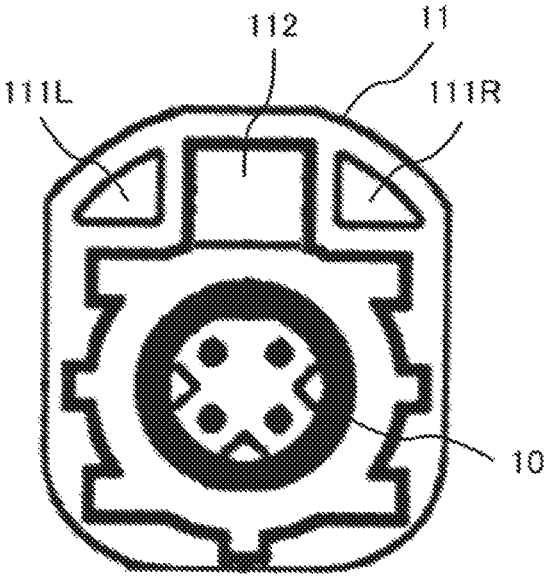
FIG. 2*b* shows a front view of the first connector.

FIG. 2 is an external view of the first connector 1. FIG. 2(*a*) is an oblique view of the first connector 1. FIG. 2(*b*) is an external view when the first connector 1 is seen from the position X shown in FIG. 2(*a*).

Figure 3A:
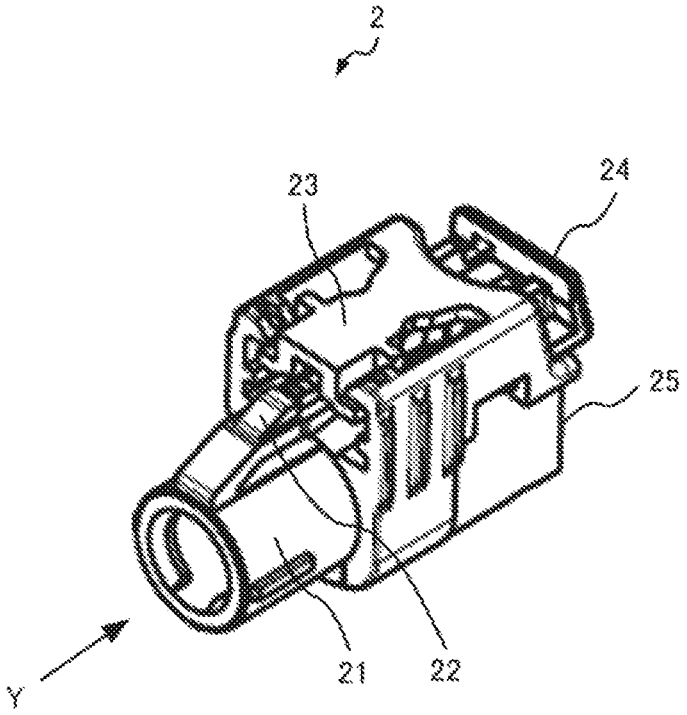
FIG. 3*a* is an external view of a second connector.
Figure 3B:
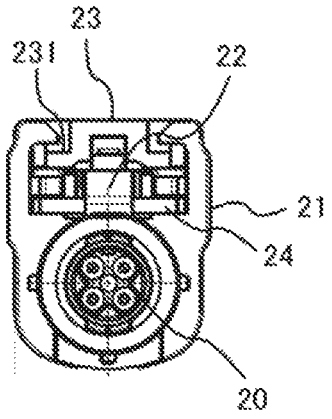
FIG. 3*b* shows a front view of the second connector.
Figure 3C:
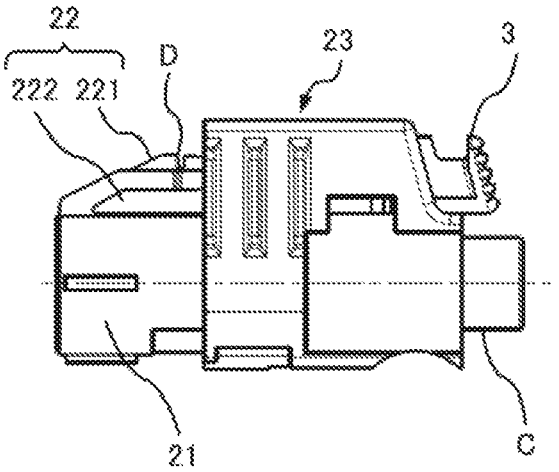
FIG. 3*c* shows a side view of the second connector.

FIG. 3 is an external view of the second connector 2. FIG. 3(*a*) is an oblique view of the second connector. FIG. 3(*b*) is an external view when the second connector 2 is seen from the position Y shown in FIG. 3(*a*). FIG. 3(*c*) is a view seen from a side surface of the second connector 2.

Figure 4A:
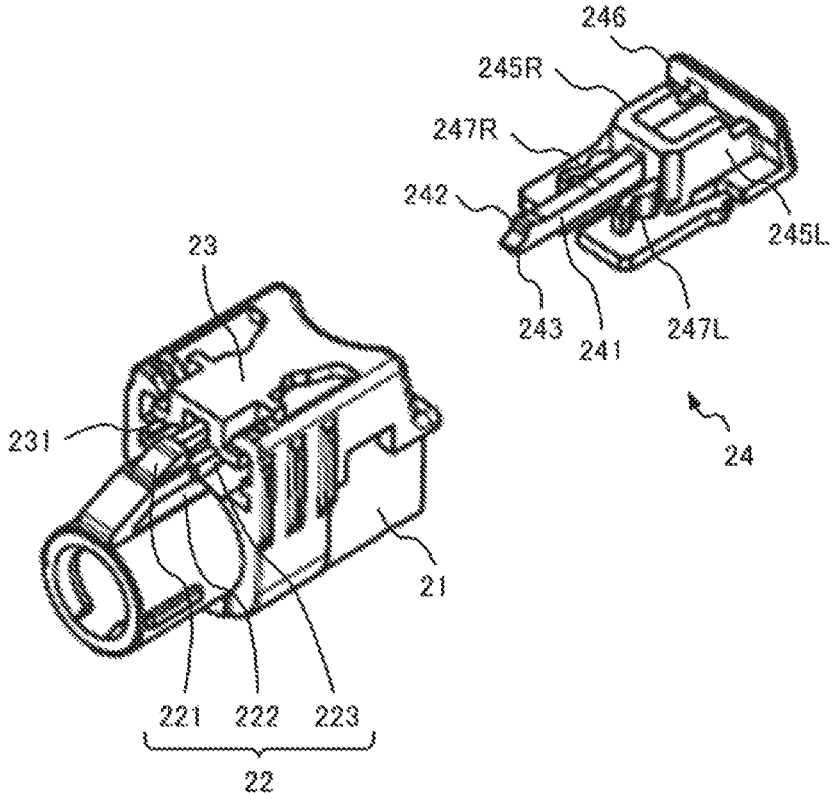
FIG. 4*a* is an exploded view of the second connector.
Figure 4B:
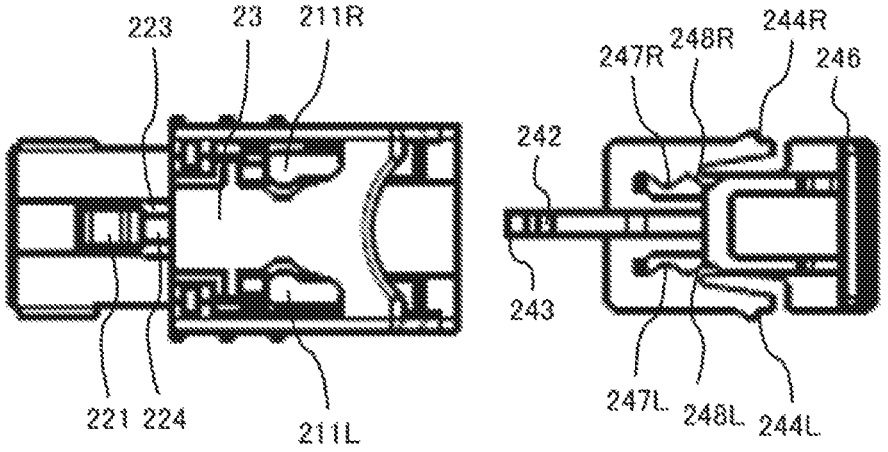
FIG. 4*b* is an exploded side view of the second connector.

FIG. 4 is an exploded view of the second connector 2. FIG. 4(*a*) is an oblique view of an exploded state of the second connector 2. FIG. 4(*b*) is a view seen from an upper surface in an exploded state of the second connector 2.

Figure 5A:
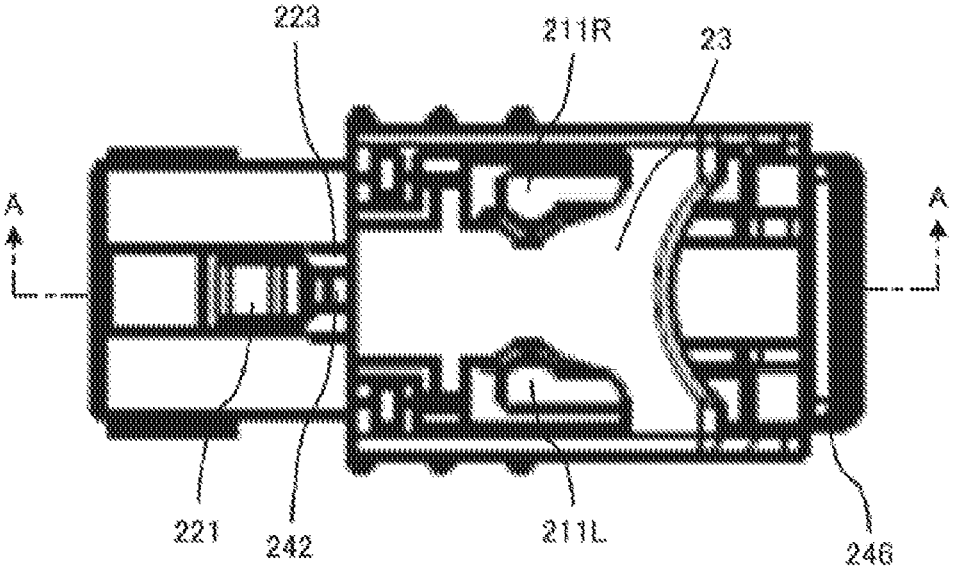
FIG. 5*a* shows the structure of the second connector in a top view in a state in which it is not mated with the first connector.
Figure 5B:
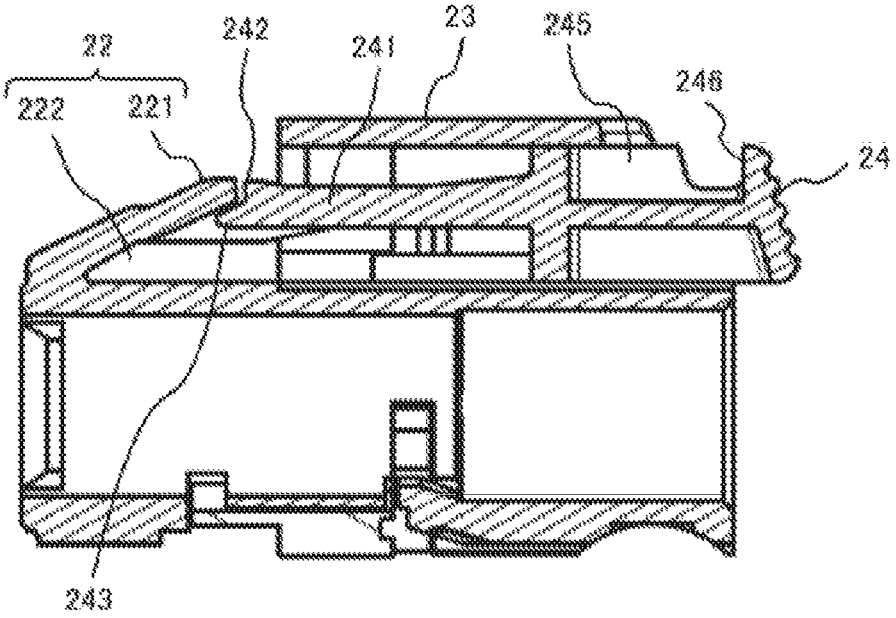
FIG. 5*b* shows the structure of the second connector in a cross section in a state in which it is not mated with the first connector.
Figure 6A:
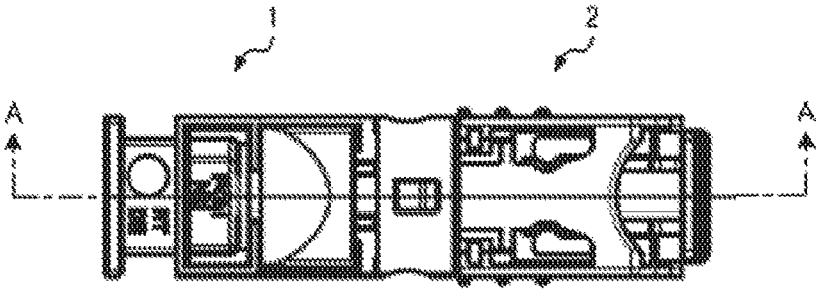
FIG. 6*a* is a schematic diagram in top view to illustrate the function of a locking member.
Figure 6B:
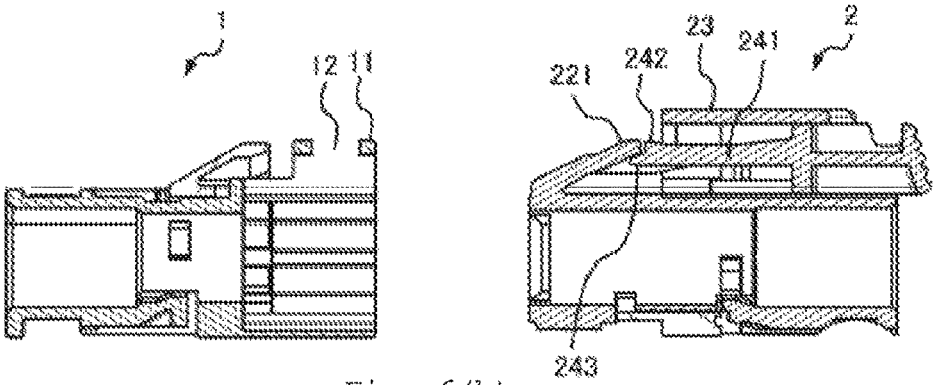
FIG. 6*b* is a schematic diagram in cross section to illustrate the function of a locking member.
Figure 6C:
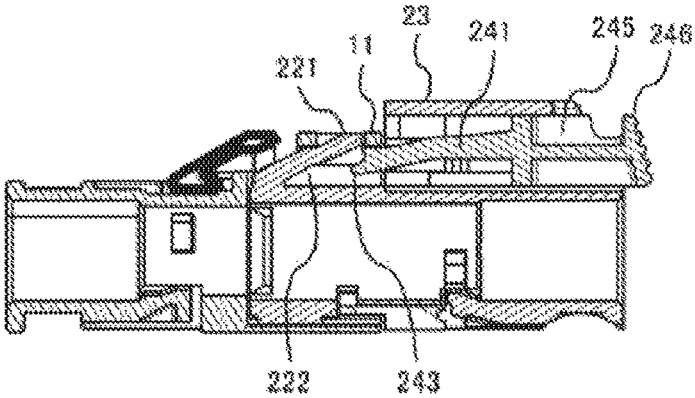
FIG. 6*c* is a schematic diagram in cross section to illustrate the function of a locking member.
Figure 6D:
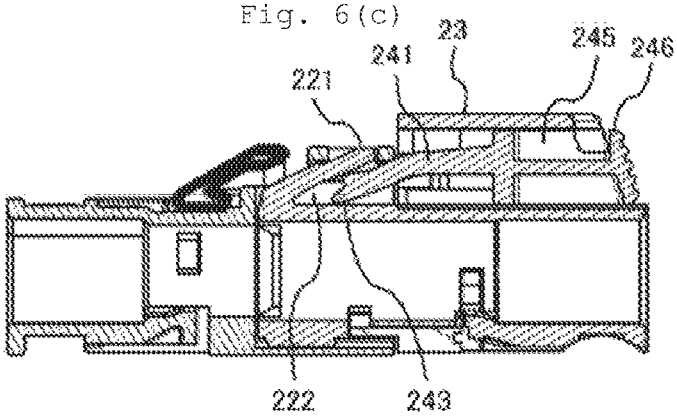
FIG. 6*d* is a schematic diagram in cross section to illustrate the function of a locking member.

FIG. 5 shows the structure of the second connector 2 in a state in which it is not mated with the first connector 1. FIG. 5(*a*) is a view seen from the upper surface of the second connector 2, and FIG. 5(*b*) is a view in cross section along the line A-A.

The first connector 1 is a high-speed data (HISD or Fakra) connector having a male terminal, for example, and the second connector 2 is an HSD or Fakra connector having a female terminal, for example. HISD or Fakra connectors are vehicle-mounted connectors for high-speed data communication.

The first connector 1 comprises: a first connection terminal 10, a first housing 11, an opening 12, and a cable connection 13. The first connection terminal 10 is a male terminal connected to a female terminal (referred to below as a second connection terminal 20) of the second connector 2, for example. The first connection terminal 10 comprises a plurality of (four in FIG. 2(*b*)) connecting pins.

The first housing 11 is a resin member provided around the first connection terminal 10. As shown in FIG. 2(*b*), an opening 111L and an opening 111R are formed in the first housing 11.

Furthermore, an opening 112 is formed in the first housing 11 between the opening 111L and the opening 111R, and at least one opening 12 is formed above the opening 112. The opening 12 is a region in which an engaging portion 22 of the second connector 2 to be described later is inserted. The opening 12 is formed on an outer peripheral surface of a cylindrical region of the first housing 11 which comes into contact with at least part of the second connector 2. In the example shown in FIG. 2(*a*), the opening 12 is formed on a side surface on an upper side of the first housing 11.

The cable connection 13 comprises an opening enabling a cable to be inserted into the first connector 1, and a connector for connecting the cable.

The second connector 2 comprises: a second connection terminal 20, a second housing 21, an engaging portion 22, an engagement release portion 23, a locking member 24, and a cable connection 25. The second connection terminal 20 is a female terminal connected to a male terminal (first connection terminal 10) of the first connector 1, for example. The second connection terminal 20 comprises a plurality of (four in FIG. 3(*b*)) connecting pins.

The second housing 21 is a resin member provided around the second connection terminal 20. The engaging portion 22 and the engagement release portion 23 are provided on the second housing 21, for example. The engaging portion 22 and the engagement release portion 23 may be integrally molded with the second housing 21 or they may be molded separately to the second housing 21 and then fixed to the second housing 21.

The engaging portion 22 is a part which engages with the opening 12 formed in the first housing 11 in a state in which the first connection terminal 10 and the second connection terminal 20 are mated and said second housing 21 is mated with the first housing 11. The engaging portion 22 is fixed to an area close to an end portion of the second housing 21 on the side which mates with the first connector 1. The engaging portion 22 is a long part which is fixed to an outer peripheral surface of a cylindrical region of the second housing 21 surrounding the second connection terminal 20, and extends away from the end portion of the second housing 21. The engaging portion 22 is formed to a thickness such as to bend in a vertical direction and deforms as a result of an external force being applied thereto so as to assume a state in which it engages with the opening 12 after insertion into the opening 12 and to assume a state enabling engagement with the opening 12 to be released.

As shown in FIG. 3 and FIG. 4, the engaging portion 22 comprises: a protrusion 221, a recess 222, a portion 223 to be depressed, and an open portion 224. The protrusion 221 is inserted into the opening 12 and engages with an inside surface of the opening 12. The protrusion 221 comprises an oblique surface which becomes higher away from the end portion of the second connector 2 on the first connector 1 side, and a perpendicular end surface starting from the highest position of the oblique surface. The end surface forms a step D, and when a user pushes in the second connector 2 towards the first connector 1, the engaging portion 22 deforms downwards as the position of the oblique surface of the protrusion 221 in contact with the end portion of the first housing 11 becomes higher, and the engaging portion 22 displaces upwards at the point in time when the step D enters the opening 12. In this state, the step D engages with the inside surface of the opening 12 whereby the second connector 2 assumes a mated state with the first connector 1.

The recess 222 is a part into which a tip end of the locking member 24 is inserted in a state in which the locking member 24 is pushed in to the first connector 1 side. The recess 222 is formed on the opposite side of the engaging portion 22 to the side on which the protrusion 221 is formed.

The recess 222 is a space between a long resin member on which the protrusion 221 is formed and the outer peripheral surface of the cylindrical region of the second housing 21 surrounding the second connection terminal 20, for example. The recess 222 may be formed by the resin member on which the protrusion 221 is formed.

The portion 223 to be depressed is a plate-shaped part to which a downward external force is applied from the engagement release portion 23 when a user pushes the engaging release portion 23 downwards, and extends to the rear of the step D. The portion 223 to be depressed may be wider than the protrusion 221 and the protrusion 221 may be formed on the portion 223 to be depressed. A downward stress is applied to the portion 223 to be depressed as a result of the engagement release portion 23 being pushed downwards, so that the long resin member including the protrusion 221 flexes and the protrusion 221 moves downwards. In this state, a user applies a force in a direction to withdraw the second connector 2 from the first connector 1, whereby mating of the first connector 1 and the second connector 2 is released.

As shown in FIG. 4(*b*), the open portion 224 is a long hole formed close to the center of the portion 223 to be depressed. A partial region including a tip end portion of the locking member 24 is inserted into the open portion 224 when a user pushes the engagement release portion 23 downwards. The detailed action produced when the user pushes the engagement release portion 23 downwards will be described later.

The engagement release portion 23 is a part to which an external force is applied by a user whereby stress is applied to the engaging portion 22 in such a way that the engaging portion 22 deforms to a state in which it is disengageable from the opening, for example. As shown in FIG. 3(*b*) and FIG. 4(*a*), the cross section of the engagement release portion 23 in a direction orthogonal to the longitudinal direction of the connecting structure S comprises a rectangular region which is open on one side in such a way as to enclose a rod-shaped portion 241 of the locking member 24 which will be described later. A plate portion 231 for applying stress to the portion 223 to be depressed when an external force pushing the engagement release portion 23 downwards is applied is formed on the left-hand side and the right-hand side of the open region.

The locking member 24 is able to move in the longitudinal direction of the connecting structure S and prevents displacement of the engaging portion 22 in a direction of disengagement from the opening in a state in which said locking member 24 is pushed in to the first connector 1 side. The locking member 24 comprises: the rod-shaped member 241, a protrusion 242, a tip end portion 243, a withdrawal-preventing portion 244, a deformation-preventing portion 245, an operating portion 246, a first positioning portion 247, and a second positioning portion 248.

The rod-shaped portion 241 is a long part extending in the front-rear direction, and the protrusion 242 and the tip end portion 243 are formed close to a tip end of the rod-shaped portion 241. As the locking member 24 is pushed in towards the first connector 1, the rod-shaped portion 241 bends downwards as a result of the protrusion 242 progressing forwards along the oblique surface of the engaging portion 22 on the opposite side to the protrusion 221.

As shown in FIG. 5(*b*), the protrusion 242 runs into the step D in a state in which the first connector 1 and the second connector 2 are not mated and the locking member 24 is not pushed in towards the first connector 1. As a result of the protrusion 242 running into the step D, the locking member 24 is maintained in a predetermined position without moving forwards in a state in which the first connector 1 and the second connector 2 are not mated.

That is to say, the locking member 24 is able to move up to a predetermined position on the side of the first connector 1 in a state in which the first connection terminal 10 and the second connection terminal 20 are mated, and does not move up to the predetermined position in a state in which the first connection terminal 10 and the second connection terminal 20 are not mated. By virtue of the second connector 2 having such a configuration, a user is able to ascertain that the first connector 1 and the second connector 2 are not mated, because of the fact that the locking member 24 cannot be moved forwards. It is therefore possible to prevent shipping of the product in a state in which the first connector 1 and the second connector 2 are not mated.

The tip end portion 243 comes into contact with a surface of the long resin member, on which the protrusion 221 is formed, on the opposite side of the engaging portion 22, in a state in which the first connector 1 and the second connector 2 are not mated and the locking member 24 is not pushed in towards the first connector 1. As the second connector 2 moves to the side of the first connector 1, the protrusion 221 moves downwards and the tip end portion 243 also moves downwards as a result.

A withdrawal-preventing portion 244R and a withdrawal-preventing portion 244L are steps for preventing withdrawal of the locking member 24 from the second housing 21. The withdrawal-preventing portion 244R and the withdrawal-preventing portion 244L run into protrusions (not depicted) formed on the second housing 21 so that the locking member 24 is unlikely to be withdrawn to the rear.

The deformation-preventing portion 245 is a rib extending in a vertical direction which does not come into contact with the engagement release portion 23 in a state in which the locking member 24 is not pushed in to the first connector 1 side, and prevents downward deformation of the engagement release portion 23 in a state in which the locking member 24 is pushed in to the first connector 1 side. As a result, the engaging portion 22 is not detached from the opening 12 even if an external force is applied to the engagement release portion 23, in a state in which the locking member 24 is pushed in to the first connection 1 side.

The operating portion 246 is a part which the user employs to move the locking member 24 in the longitudinal direction, and comprises a step on which a user may catch a nail. The lateral width of the operating portion 246 is greater than the lateral width of an open portion at the rear of the second housing 21.

A first positioning portion 247R and a first positioning portion 247L, and a second positioning portion 248R and a second positioning portion 248L are recesses for determining the position of the locking member 24 in the front-rear direction. The first positioning portion 247R and the first positioning portion 247L respectively engage with a projection 211R and a projection 211L formed on the second housing 21, whereby it is possible to prevent the locking member 24 from moving without a user operation in a state in which the locking member 24 is not pushed in to the first connector 1 side. The second positioning portion 248R and the second positioning portion 248L respectively engage with the projection 211R and the projection 211L, whereby it is possible to prevent the locking member 24 from moving without a user operation in a state in which the locking member 24 is pushed in to the first connector 1 side.

FIG. 6 is a diagram to illustrate the function of the locking member 24. FIG. 6(*a*) is an oblique view of the upper surface of the first connector 1 and the second connector 2. FIG. 6(*b*) is a view in cross section along the line A-A in a state in which the first connector 1 and the second connector 2 are not mated. FIG. 6(*c*) is a view in cross section along the line A-A in a state in which the first connector 1 and the second connector 2 are mated and the locking member 24 is not pushed in to the first connector 1 side. FIG. 6(*d*) is a view in cross section along the line A-A in a state in which the first connector 1 and the second connector 2 are mated and the locking member 24 is pushed in to the first connector 1 side.

As shown in FIG. 6(*c*), in a state in which the first connector 1 and the second connector 2 are mated, the protrusion 242 is inserted into the open portion 224 and assumes a state of contact with the inner surface of the first housing 11 at the rear (second connector 2 side) of the opening 12. In this state, the rod-shaped portion of the locking member 24 is bent downwards.

When the user pushes the operating portion 246 forwards in the state shown in FIG. 6(*c*), the rod-shaped portion 241 flexes further, and the tip end portion 243 is inserted to the front of the recess 222 and runs into a bottom surface of the recess 222. In this state, the deformation-preventing portion 245 is positioned below the engagement release portion 23 while the tip end portion 243 also runs into the bottom surface of the recess 222, so there is substantially no deformation of the rod-shaped portion 241 even if an external force pushing the engagement release portion 23 downwards is applied. The amount of displacement of the protrusion 221 in a direction of disengagement from the opening 12 in a state in which the locking member 24 is inserted in the recess 222 is therefore smaller than the amount of displacement of the protrusion 221 in the direction of disengagement from the opening 12 in a state in which the locking member 24 is not inserted in the recess 222.

As a result, the connecting structure S is such that when an external force is applied to the engagement release portion 23 in a state in which the locking member 24 is pushed in to the first connector 1 side, the engagement release portion 23 deforms in such a way as to apply a smaller stress than the stress required in order for the engaging portion 22 to deform to a state in which it is disengageable from the opening 12. Accordingly, the engaging portion 22 does not become disengaged from the opening 12 and a state in which the engaging portion 22 is inserted in the opening 12 is maintained.

Meanwhile, when an external force is applied to the engagement release portion 23 in a state in which the locking member 24 is not pushed in to the first connector 1 side, the engaging release portion 23 deforms in such a way as to apply the stress required in order for the engaging portion 22 to deform to a state in which it is disengageable from the opening. When the user applies a force separating the first connector 1 and the second connector 2 in this state, the second connector 2 can be removed from the first connector 1.

As described above, the second connector 2 of the connecting structure S according to this mode of embodiment comprises: the second housing 21 which is provided around the second connection terminal 20 and has the engaging portion 22 which engages with the opening 12 formed in the first housing 11 in a state in which the first connection terminal 10 of the first connector 1 and the second connection terminal 20 of the second connector 2 are mated and said second housing 21 is mated with the first housing 11, and the locking member 24 which is able to move in the longitudinal direction of the connecting structure S and prevents displacement of the engaging portion 22 in a direction of disengagement from the opening 12 in a state in which said locking member 24 is pushed in to the first connector 1 side. By virtue of the second connector 2 having this configuration, the engaging portion 22 is not disengaged from the opening 12 in a state in which the locking member 24 is pushed in to the first connector 1 side, so a state in which the first connector 1 and the second connector 2 are securely mated is readily maintained.

Furthermore, the locking member 24 is able to move up to a predetermined position on the first connector 1 side in a state in which the first connection terminal 10 and the second connection terminal 20 are mated, and does not move up to the predetermined position in a state in which the first connection terminal 10 and the second connection terminal 20 are not mated. By virtue of the second connector 2 having such a configuration, a user is able to ascertain that the first connector 1 and the second connector 2 are not mated, because of the fact that the locking member 24 cannot be moved forwards, so the first connector 1 and the second connector 2 can be securely mated.

The present invention was described above with the aid of a mode of embodiment, but the technical scope of the present invention is not limited to the scope disclosed in the abovementioned mode of embodiment. It will be obvious to a person skilled in the art that various modifications or improvements may be added to the abovementioned mode of embodiment. It will be obvious from the disclosure of the claims that modes to which such modifications or improvements have been added may also be included within the technical scope of the present invention.

The present disclosure may be summarized as disclosing, inter alia, the following Embodiments.

Embodiment 1

Connecting structure for connecting a first connector having a first connection terminal, and a second connector having a second connection terminal able to mate with the first connection terminal, characterized in that the first connector comprises a first housing provided around the first connection terminal and having at least one opening, and the second connector comprises:

a second housing which is provided around the second connection terminal and has an engaging portion which engages with the opening formed in the first housing in a state in which the first connection terminal and the second connection terminal are mated and said second housing is mated with the first housing, and a locking member which is able to move in a longitudinal direction of the connecting structure and prevents displacement of the engaging portion in a direction of disengagement from the opening in a state in which said locking member is pushed in up to a predetermined position on the first connector side.

Embodiment 2

Connecting structure according to Embodiment 1, characterized in that the locking member is able to move up to the predetermined position in a state in which the first connection terminal and the second connection terminal are mated, and does not move up to the predetermined position in a state in which the first connection terminal and the second connection terminal are not mated.

Embodiment 3

Connecting structure according to Embodiment 1 or 2, characterized in that the engaging portion deforms to a state in which it is disengageable from the opening as a result of an external force being applied in a state in which the locking member is not pushed in to the first connector side, and the engaging portion does not deform to a state in which it is disengageable from the opening when an external force is applied in a state in which the locking member is pushed in to the first connector side.

Embodiment 4

Connecting structure according to Embodiment 3, characterized in that the second housing further comprises an engagement release portion for applying stress to the engaging portion in such a way that the engaging portion deforms to a state in which it is disengageable from the opening as a result of the external force being applied.

Embodiment 5

Connecting structure according to Embodiment 4, characterized in that, when the external force is applied to the engagement release portion in a state in which the locking member is not pushed in to the first connector side, the engagement release portion deforms in such a way as to apply the stress required in order for the engaging portion to deform to a state in which it is disengageable from the opening, and when the external force is applied to the engagement release portion in a state in which the locking member is pushed in to the first connector side, the engagement release portion deforms in such a way as to apply a smaller stress than the stress required in order for the engaging portion to deform to a state in which it is disengageable from the opening.

Embodiment 6

Connecting structure according to Embodiment 4 or 5, characterized in that the locking member comprises a deformation-preventing portion which does not come into contact with the engagement release portion in a state in which the locking member is not pushed in to the first connector side, and which prevents deformation of the engagement release portion in a state in which the locking member is pushed in to the first connector side.

Embodiment 7

Connecting structure according to any one of Embodiments 1 to 6, characterized in that the engaging portion comprises:

a recess into which a tip end of the locking member is inserted in a state in which the locking member is pushed in to the first connector side, and a protrusion engaging with the opening, and the amount of displacement of the protrusion in a direction of disengagement from the opening in a state in which the locking member is inserted in the recess is smaller than the amount of displacement of the protrusion in the direction of disengagement from the opening in a state in which the locking member is not inserted in the recess.

Embodiment 8

Connector characterized in that it comprises:

a second connection terminal able to mate with a first connection terminal of another connector, a second housing which is provided around the second connection terminal and has an engaging portion which engages with an opening formed in a housing of the other connector in a state in which the first connection terminal and the second connection terminal are mated and said second housing is mated with the housing of the other connector, and a locking member which is able to move to the other connector side and prevents displacement of the engaging portion in a direction of disengagement from the opening in a state in which said locking member is pushed in up to a predetermined position on the other connector side.

LIST OF REFERENCE SIGNS

1 First connector
2 Second connector
10 First connection terminal
11 First housing
12 Opening
13 Cable connection
20 Second connection terminal
21 Second housing
22 Engaging portion
23 Engagement release portion
24 Locking member
25 Cable connection
111, 112 Opening
211 Projection
221 Protrusion
222 Recess
223 Portion to be depressed
224 Open portion
231 Plate portion
241 Rod-shaped portion
242 Protrusion
243 Tip end portion
244 Withdrawal-preventing portion
245 Deformation-preventing portion
246 Operating portion
247 First positioning portion
248 Second positioning portion

The invention claimed is:

1. A connector assembly, comprising:

a first connector;

a second connector that matingly engages said first connector; and a locking member, wherein said first connector comprises a first connection terminal and a first housing that partially encloses said first connection terminal, said first housing comprising an opening, said second connector comprises a second connection terminal, an engaging portion and a second housing that partially encloses said second connection terminal, in a mated state of said first connection terminal and said second connection terminal, said engaging portion engages said opening, in a locked state of said locking member, a tip portion of said locking member is wedged between said engaging portion and a surface of said second connector, said locking member thus preventing disengagement of said engaging portion from said opening, in said mated state, said engaging portion is disengageable from said opening by a deformation of said engaging portion, said second connector comprises an engagement release portion that applies a deforming force to said engaging portion that effects said deformation, and said second connector comprises a first cantilever and a second cantilever distinct from said first cantilever, said first cantilever comprising said engaging portion and said second cantilever comprising said engagement release portion.

2. The connector assembly of claim 1, wherein:

in a mated state of said first connection terminal and said second connection terminal, said locking member is movable in a longitudinal direction of said connector assembly between a locking position and an unlocked position, and in an unmated state of said first connection terminal and said second connection terminal, said locking member is inhibited from moving from said unlocked position to said locking position.

3. The connector assembly of claim 2, wherein:

said engaging portion comprises a recess and a protrusion, said protrusion engaging said opening in said mated state, in said locked state, said recess receives said tip portion of said locking member and said tip portion limits displacement of said protrusion in a direction of disengagement from said opening to less than an amount of displacement required to disengage said protrusion from said opening, and in said unlocked position of said locking member, said recess does not receive said tip portion that inhibits disengagement of said protrusion from said opening.

4. The connector assembly of claim 2, wherein:

in said locking position, said locking member inhibits said deformation of said engaging portion, and in said unlocked position, said locking member permits said deformation of said engaging portion.

5. The connector assembly of claim 1, wherein:

in said locking position, said locking member inhibits a deformation of said engagement release portion required to apply said deforming force to said engaging portion, and in said unlocked position, said locking member permits said deformation of said engagement release portion required to apply said deforming force to said engaging portion.

6. The connector assembly of claim 1, wherein:

said locking member comprises a deformation-inhibiting portion that, in said unlocked position of said locking member, does not contact said engagement release portion, and in said locking position of said locking member, said deformation-inhibiting portion inhibits said deformation of said engagement release portion.

7. The connector assembly of claim 1, wherein:

said engaging portion comprises a recess and a protrusion, said protrusion engaging said opening in said mated state, and in said locked state, said recess receives said tip portion of said locking member and said tip portion limits a displacement of said protrusion in a direction of disengagement from said opening to less than an amount of displacement required to disengage said protrusion from said opening.

8. The connector assembly of claim 1, wherein:

said second connector comprises said locking member.

9. The connector assembly of claim 1, wherein:

in said locked state, a first plane perpendicular to a longitudinal axis of said connector assembly intersects a first portion of said locking member and a portion of said first connector and a second plane perpendicular to said longitudinal axis of said connector assembly intersects a second portion of said locking member and a portion of said second connector, said locking member prevents disengagement of said engaging portion from said opening.

10. A connector assembly, comprising:

a first connector;

a second connector that matingly engages said first connector; and a locking member, wherein said first connector comprises a first connection terminal and a first housing that partially encloses said first connection terminal, said first housing comprising an opening, said second connector comprises a second connection terminal, an engaging portion and a second housing that partially encloses said second connection terminal, in a mated state of said first connection terminal and said second connection terminal, said engaging portion engages said opening, in a locked state of said locking member, said locking member prevents disengagement of said engaging portion from said opening, in a mated state of said first connection terminal and said second connection terminal, said engaging portion is disengageable from said opening by a deformation of said engaging portion, said second housing comprises a cantilever engagement release portion that applies a deforming force to said engaging portion that effects said deformation, in said locking position, said locking member inhibits a deformation of said cantilever engagement release portion, in said unlocked position, said locking member permits said deformation of said cantilever engagement release portion required to apply said deforming force to said engaging portion, and in said locking position, said cantilever engagement release portion straddles said locking member.

11. The connector assembly of claim 10, wherein:

said locking member comprises a deformation-inhibiting portion that, in said unlocked position of said locking member, does not contact said cantilever engagement release portion, and in said locking position of said locking member, said deformation-inhibiting portion inhibits said deformation of said cantilever engagement release portion.

12. The connector assembly of claim 10, wherein:

in said mated state, said locking member is movable in a longitudinal direction of said connector assembly between a locking position and an unlocked position, and in an unmated state of said first connection terminal and said second connection terminal, said locking member is inhibited from moving from said unlocked position to said locking position.

13. The connector assembly of claim 10, wherein:

in said locking position, said locking member inhibits said deformation of said engaging portion, and in said unlocked position, said locking member permits said deformation of said engaging portion.

14. The connector assembly of claim 10, wherein:

said engaging portion comprises a recess and a protrusion, said protrusion engaging said opening in said mated state, and in said locked state, said recess receives said tip portion of said locking member and said tip portion limits a displacement of said protrusion in a direction of disengagement from said opening to less than an amount of displacement required to disengage said protrusion from said opening.

15. The connector assembly of claim 10, wherein:

in said locked state, a first plane perpendicular to a longitudinal axis of said connector assembly intersects a first portion of said locking member and a portion of said first connector and a second plane perpendicular to said longitudinal axis of said connector assembly intersects a second portion of said locking member and a portion of said second connector, said locking member prevents disengagement of said engaging portion from said opening.

* * * * *